US010244842B2

(12) United States Patent
Tirado

(10) Patent No.: US 10,244,842 B2
(45) Date of Patent: Apr. 2, 2019

(54) BLADE DISPOSAL CONTAINER

(71) Applicant: Luis Tirado, Apopka, FL (US)

(72) Inventor: Luis Tirado, Apopka, FL (US)

( * ) Notice: Subject to any disclaimer, the term of this patent is extended or adjusted under 35 U.S.C. 154(b) by 170 days.

(21) Appl. No.: 15/496,083

(22) Filed: Apr. 25, 2017

(65) Prior Publication Data

US 2017/0305664 A1 Oct. 26, 2017

Related U.S. Application Data

(60) Provisional application No. 62/327,182, filed on Apr. 25, 2016.

(51) Int. Cl.
*A45D 27/24* (2006.01)

(52) U.S. Cl.
CPC ..... *A45D 27/24* (2013.01)

(58) Field of Classification Search
CPC ... A45D 27/24; B65F 1/02; B65F 1/10; B65F 1/16; B65D 83/10; B65D 2313/04; B65D 2209/00; Y10S 206/813; Y10S 206/818; Y10S 211/01; Y10S 220/908; A61B 50/362; A61B 2050/008; A61B 17/06161; A61B 17/3217
USPC ..... 206/350, 352–360, 818; 220/230, 483; 221/102, 212
See application file for complete search history.

(56) References Cited

U.S. PATENT DOCUMENTS 2,065,607 A 12/1936 Louis
2,441,777 A * 5/1948 Testi ..... B65D 83/10 206/354
2,453,238 A 11/1948 Locke, Jr.
2,655,257 A * 10/1953 Testi ..... B65D 83/10 206/357
3,760,938 A * 9/1973 Ferrier, Jr. ..... B65D 83/10 206/228
4,736,844 A 4/1988 Scott et al.
4,792,058 A * 12/1988 Parker ..... B65D 83/12 206/39.4
4,928,823 A * 5/1990 Campbell ..... A45C 13/02 206/338
5,080,230 A * 1/1992 Winnard ..... B25H 3/06 206/350
5,139,167 A * 8/1992 McCarthy ..... B65D 83/10 206/354
5,145,063 A * 9/1992 Lee ..... A61B 50/362 206/364

(Continued)

*Primary Examiner* — Chun Cheung
*Assistant Examiner* — Brijesh V. Patel
(74) *Attorney, Agent, or Firm* — Global Intellectual Property Agency, LLC; Daniel Boudwin

(57) ABSTRACT

A blade disposal container is provided. The blade disposal container includes a housing including an upper end, a base, a first sidewall opposing a second sidewall, a rear wall, and an open front face including a perimeter edge. A slot disposed on the upper end extends through the upper end and into the interior volume and is configured to receive a utility blade therethrough. A channel disposed adjacent the perimeter edge of the open front face enables a shield to slidably retract and extend over the open front face. A magnetic member removably attachable to the base fastens the shield over the open front face and is configured to draw the utility blade into the interior volume and magnetically adhere the blade against the base via its magnetic field.

8 Claims, 5 Drawing Sheets

(56) References Cited

U.S. PATENT DOCUMENTS

| | | | | |
|---|---|---|---|---|
| 5,181,609 | A * | 1/1993 | Spielmann | A61B 50/362 206/366 |
| 5,881,878 | A * | 3/1999 | Faccioli | A61B 50/22 206/339 |
| 6,286,675 | B1 | 9/2001 | Schmidt | |
| 6,520,367 | B1 * | 2/2003 | Piroch | A47F 1/06 220/4.21 |
| 6,786,349 | B2 * | 9/2004 | Najd | B65F 1/141 220/483 |
| 7,789,229 | B2 * | 9/2010 | Frakes | B25H 3/02 206/350 |
| 7,971,715 | B1 * | 7/2011 | Fernandes | A61B 90/98 116/100 |
| 9,033,184 | B2 | 5/2015 | Walter | |
| 2004/0262315 | A1 * | 12/2004 | Yoon | B65D 43/162 220/480 |
| 2006/0096877 | A1 * | 5/2006 | Khajavi | A61B 50/3001 206/363 |
| 2009/0317002 | A1 * | 12/2009 | Dein | A61B 19/0256 382/224 |
| 2011/0042253 | A1 * | 2/2011 | Levine | A61B 50/362 206/366 |
| 2012/0006705 | A1 * | 1/2012 | Singh | B25H 3/00 206/359 |
| 2013/0126550 | A1 * | 5/2013 | Schneider | B65D 83/10 221/270 |
| 2016/0286930 | A1 * | 10/2016 | Wolfe | A45D 27/24 |

* cited by examiner

BLADE DISPOSAL CONTAINER

CROSS REFERENCE TO RELATED APPLICATIONS

This application claims the benefit of U.S. Provisional Application No. 62/327,182 filed on Apr. 25, 2016. The above identified patent application is herein incorporated by reference in its entirety to provide continuity of disclosure.

BACKGROUND OF THE INVENTION

The present invention relates to blade disposal containers. More specifically, the present invention relates to a blade disposal container configured to facilitate the receiving and containment of discarded razor blades therein.

Used razor blades often become dull and worn to the point where they cannot be efficiently used for their intended purposes. Thus, users typically dispose of dulled razor blades in ordinary trash bins or containers and then replace them with a sharper, more efficient blade. However, even when dulled after prolonged use, a razor blade remains sharp enough to be hazardous. Therefore, the used razor blades need to be disposed of in a safer more convenient way.

Although, many disposal containers for used blades are known in the art, they are not particularly well suited for receiving razor blades and securing them in the interior of the container. For instance, many prior disposal containers require users to insert the blade manually, i.e., using their hands alone to discard the blade, which increases the risk of injury. Many disposal containers known in the art require direct insertion of the blade in a specific manner in order for it to properly fall into the interior of the container. Further, many prior disposal containers fail to include a mechanism for guiding the blade into the interior thereof. Thus, there is a need for a blade disposal container which is configured to facilitate the insertion and storage of blades therein.

Another problems with prior blade disposal containers is that they are often not easily identifiable as such. For instance, many prior blade disposal containers are often disguised simply as regular containers, providing no evidence that they are actually a container full of harmful razor blades. Thus, there is a need for a blade disposal container which includes a transparent portion which makes it easy to identify the razor blades therein.

In light of the prior blade disposal containers disclosed in the known art, it is submitted that the present invention substantially diverges in design elements from the known art and consequently it is clear that there is a need in the art for an improvement to blade disposal containers. In this regard the present invention substantially fulfills these needs.

SUMMARY OF THE INVENTION

In view of the foregoing disadvantages inherent in the known types of blade disposal receptacles now present in the prior art, the present invention provides a blade disposal container wherein the same can be utilized for providing convenience for the user when disposing of razor blades, such as utility blades.

An embodiment of the present invention comprises a housing including an upper end, a base, a first sidewall opposing a second sidewall, a rear wall, and an open front face including a perimeter edge. A slot disposed on the upper end extends through the upper end and into the interior volume and is configured to receive a utility blade therethrough. A channel disposed adjacent the perimeter edge of the open front face enables a shield to slidably retract and extend over the open front face. A magnetic member removably attachable to the base fastens the shield over the open front face and is configured to draw the utility blade into the interior volume and magnetically adhere the blade to the base via its magnetic field.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
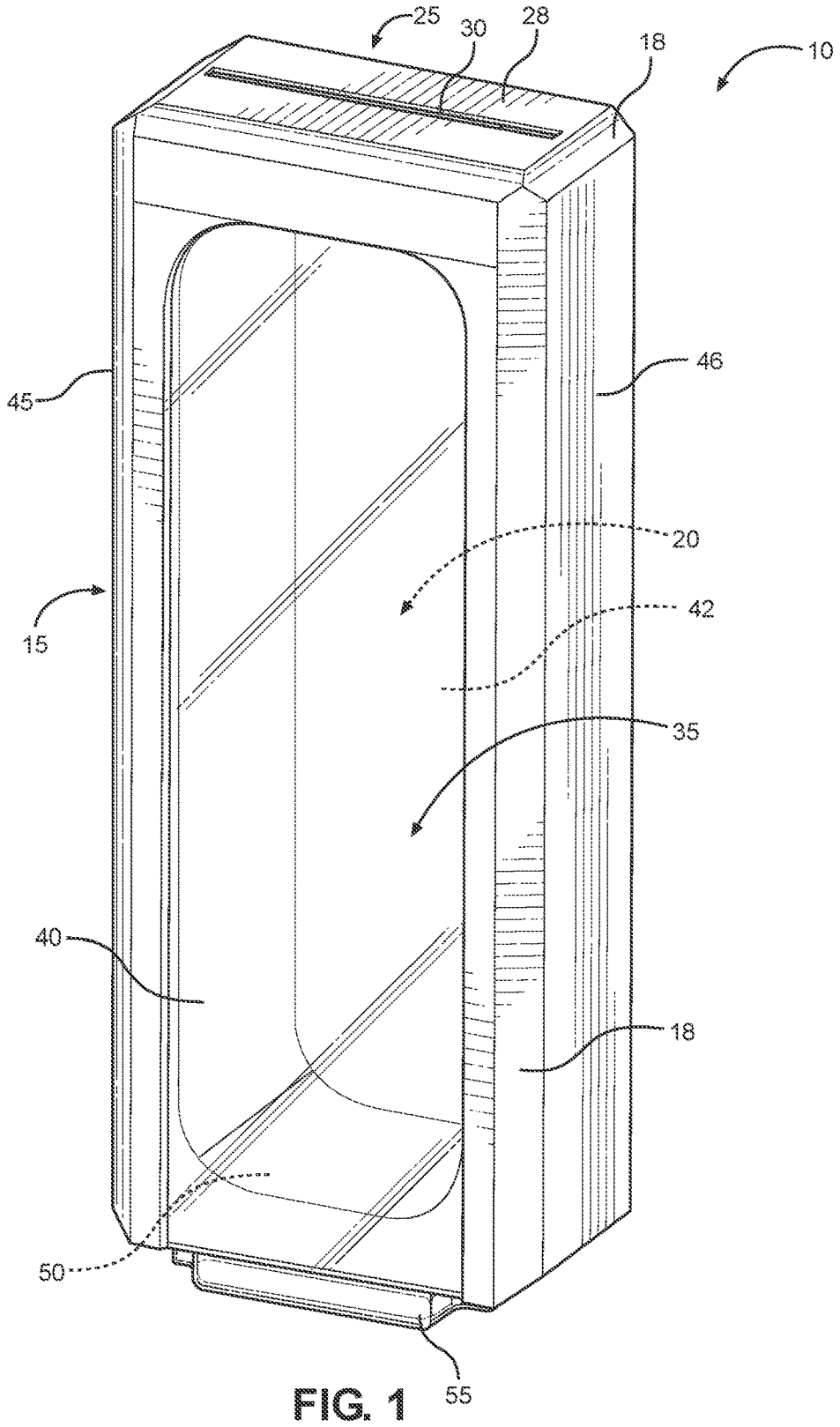
FIG. 1 shows a top perspective view of the blade disposal container.

Reference is made herein to the attached drawings. Like reference numerals are used throughout the drawings to depict like or similar elements of the blade disposal container. The figures are intended for representative purposes only and should not be considered to be limiting in any respect.

Figure 2:
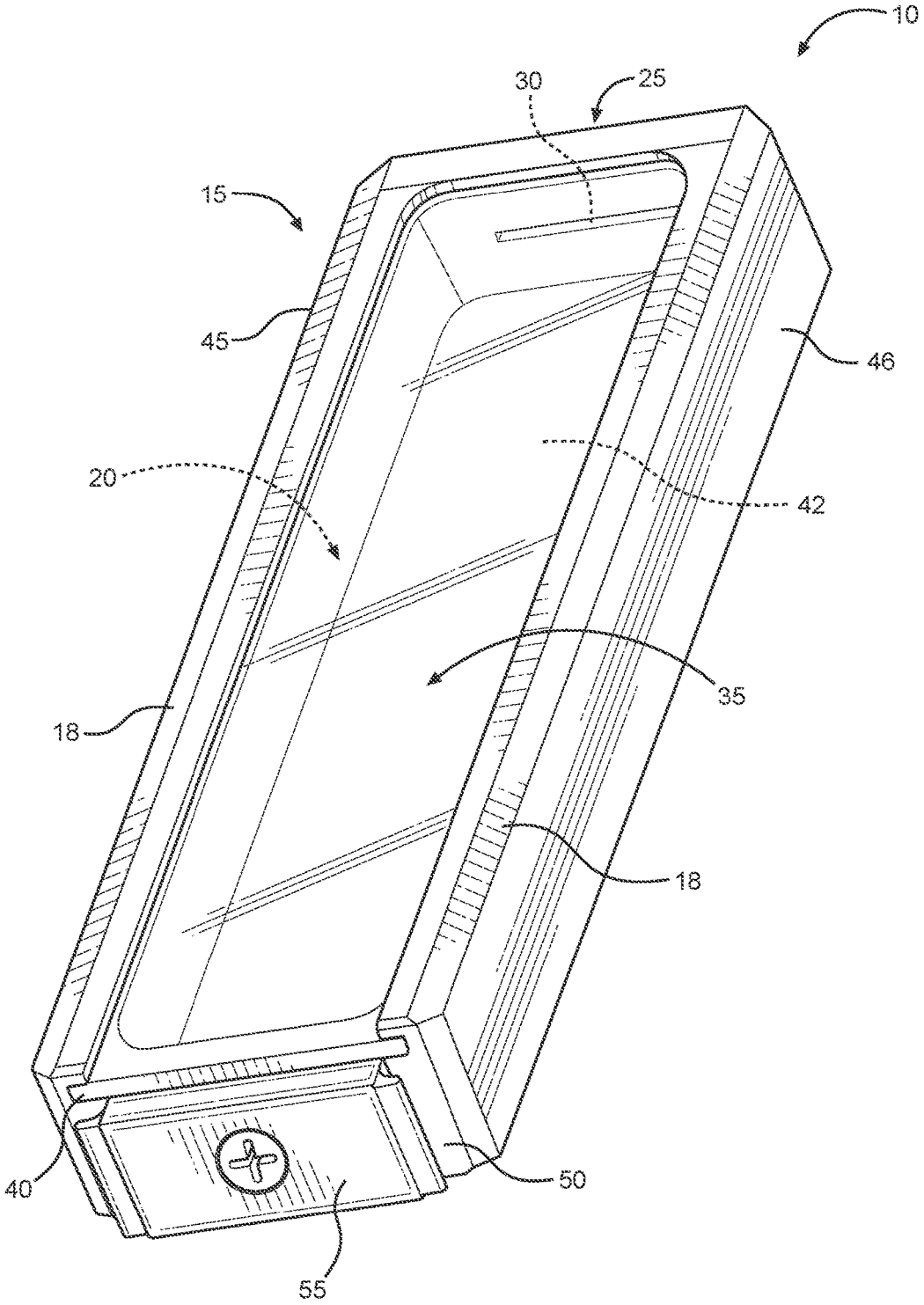
FIG. 2 shows a bottom perspective view of the blade disposal container.
Figure 3:
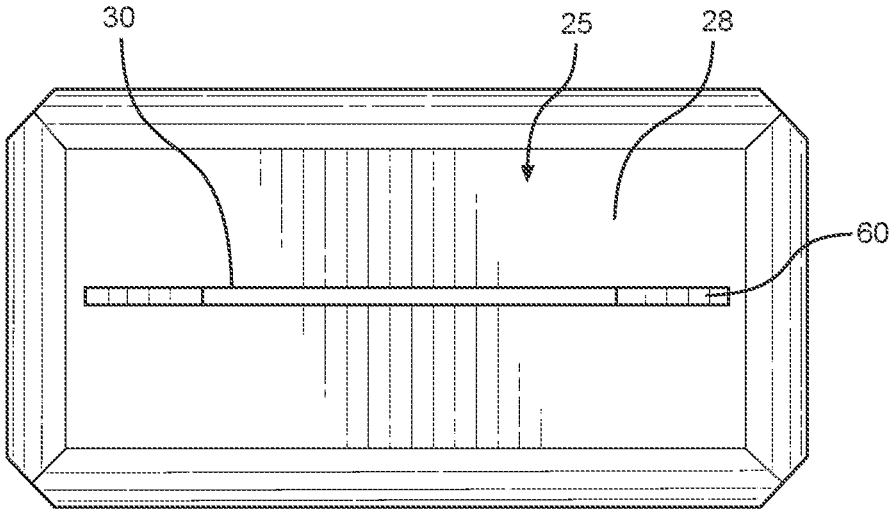
FIG. 3 shows a top plan view of the blade disposal container.

Referring now to FIGS. 1-3, there are shown top and bottom perspective views and a top plan view of the blade disposal container, respectively. The present invention comprises a blade disposal container 10 including a housing 15 configured to receive, draw in, and enclose dulled utility blades therein. The housing 15 includes an interior volume 20, an upper end 25 including a slot 30 for receiving utility blades therethrough, an open front face 35 including a shield 40 slidably disposed therein, a closed rear wall 42, a first sidewall 45 opposing a second sidewall 46, and a base 50 including a magnetic member 55 removably coupled thereto. In the depicted embodiment, the housing 15 is a rectangular-shaped container including chamfered edges 18. In alternative embodiments, the housing 15 may include any variety of shapes, such as a square shape or circular shape. The upper end 25 includes a planar face 28 which provides a smooth surface thereon.

The slot 30 extends longitudinally along the planar face 28 of the upper end 25 of the housing 15. The slot 30 extends radially inwardly through the upper end 25 to provide access to the interior volume 20 of the housing 15. In one embodiment, the slot 30 is positioned along a center of the upper end 25 and extends longitudinally from one side of the upper end 25 to an opposing side. The slot 30 includes sloping interior walls 60, as shown in FIG. 3. The sloping interior walls 60 slope downwardly and inwardly from the planar face 28 towards the interior volume 20. In operation, a user inserts a dull utility blade into the slot 25 and snaps the utility blade therein. The sloping interior walls 60 guide the utility blade inserted therein towards the interior volume 20. In this way, every utility blade broken off in the slot 30 is guided directly into the interior volume 20.

Figure 4:
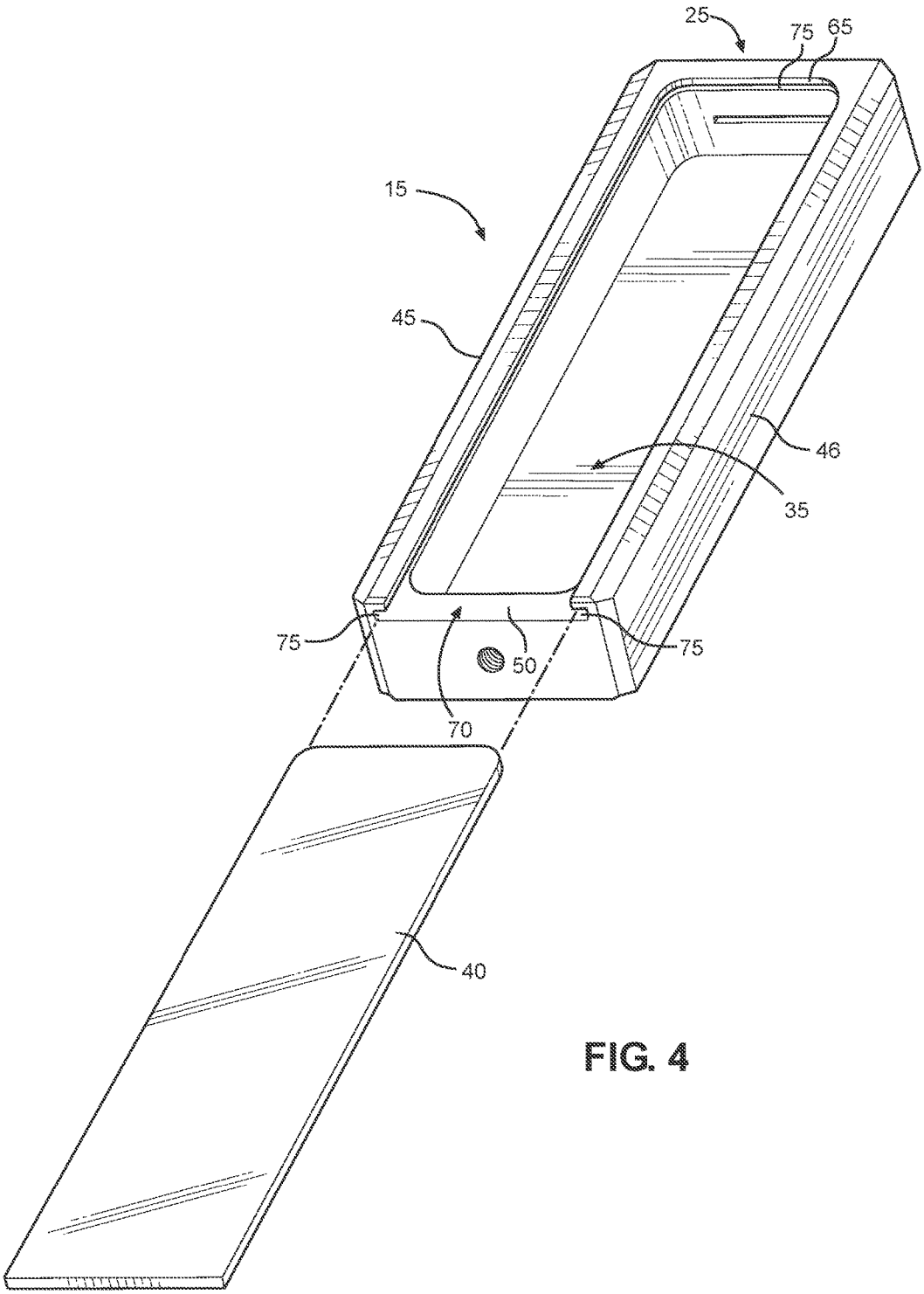
FIG. 4 shows an exploded view of the shield of the blade disposal container.

Referring now to FIG. 4, there is shown an exploded view of the shield of the blade disposal container. The open front face 35 of the housing 15 extends longitudinally from the upper end 25 of the housing 15 to the base 50 of the housing 15 and extends laterally between the first sidewall 45 of the housing 15 towards the second sidewall 46. The open front face 35 defines a perimeter edge 65 extending along the first and second sidewalls 45, 46 and the upper end 25. A channel 75 disposed within the perimeter edge 65 of the open front face 35 is configured to slidably receive the shield 40. An opening 70 in the perimeter edge 65 is disposed adjacent to the base 50 and extends longitudinally along the base 50. The opening 70 is coupled to the channel 75 and facilitates insertion of the shield 40 into the channel 75.

In the depicted embodiment, the channel 75 is disposed underneath the perimeter edge 65 towards the interior volume of the housing 15. The shield 40 comprises a planar member that is slidably retractable and extendable along the channel 75 via the opening 70. In this way, the shield 40 may extend from the open front face 35 in order to provide access to the interior volume or retract over the open front face 35 in order to completely cover the open front face 35 and enclose the interior volume. In one embodiment, the shield 40 comprises a transparent planar member, such that the interior volume and the base 50 are viewable when the shield 40 is retracted over the open front face 35. In the depicted embodiment, the shield 40 comprises a transparent plastic material, however, in alternative embodiments, the shield 40 may comprise colored and transparent plastic materials, glass or other similar materials.

Figure 5:
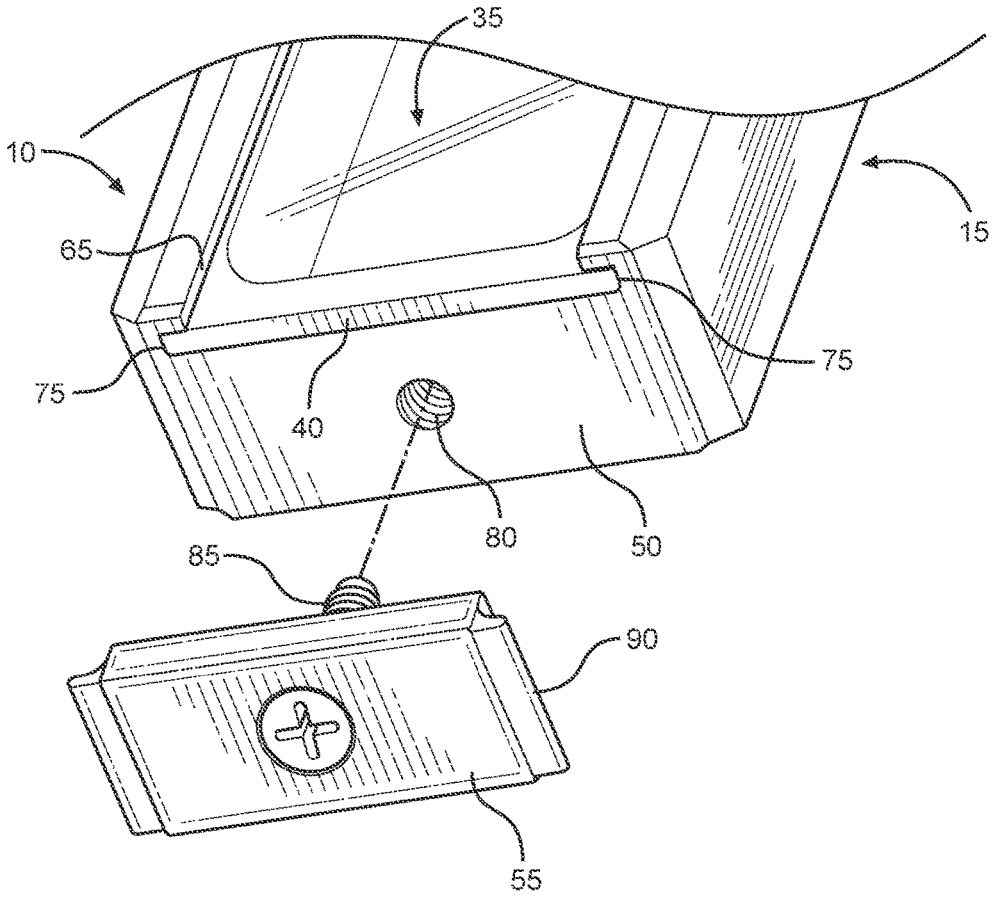
FIG. 5 shows an exploded view of the magnetic member of the blade disposal container.

Referring now to FIG. 5, there is shown an exploded view of the magnetic member of the blade disposal container. The magnetic member 55 is removably securable to the base 50 and comprises a permanent magnet including a ferromagnetic material, such as iron, nickel, or cobalt. The magnetic member 55 includes a width larger than a width of the base 50, such that when coupled to the base 50, the magnetic member 55 covers the opening of the perimeter edge 65 of the open front face 35 and secures the shield 40 within the channel 75. In this way, the magnetic member 55 also functions as a fastener for securing the shield 40 over the open front face 35 of the housing 15.

In the depicted embodiment, the base 50 includes a threaded aperture 80 configured to receive a threaded member 85 disposed on the magnetic member 55, thereby permitting the magnetic member 55 to threadably couple to the base 50. In one embodiment, the threaded member 85 comprises an adjustable screw which enables a user to tighten or loosen the magnetic member 55 to and from the base 50. In one embodiment, the magnetic member 55 includes a protective sleeve 90 for enclosing and containing the magnetic member 55 therein in order to prevent the magnetic member 55 from chipping, cracking, or breaking.

When coupled or fastened to the base 50, the magnetic member 55 forms a magnetic field around the base 50, thereby attracting metallic objects thereto, such as utility blades, and magnetically adhering the objects to the base 50. In this way, blades broken off into the housing 15 are drawn into the interior volume towards the base 50 and held securely against the base 50, such that they are unable to move within the interior volume when the blade disposal container 10 is in use. When removed from the base 50, however, the magnetic field formed around the base 50 by the coupling of the magnetic member 55 to the base 50 is weakened, since the magnetic member 55 is no longer coupled to the base 50. Thus, all blades magnetically adhered to the base 50 are released into the interior volume, enabling a user to more easily remove the blades therefrom.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A blade disposal container, comprising: a housing including an upper end, a base, a first sidewall opposing a second sidewall, a rear wall, and an open front face, the open front face including a perimeter edge;

a slot extending through the upper end into the interior volume, the slot configured to receive a blade therethrough;

a shield slidably disposed over the open front face; a channel disposed adjacent the perimeter edge, the channel configured to slidably receive the shield; and a magnetic member removably coupled to the base, the magnetic member configured to draw a blade into the interior volume and magnetically adhere the blade to the base, and wherein the magnetic member includes a width larger than a width of the base, the magnetic member configured to cover the opening of the perimeter edge and fasten the shield over the open front face.

2. The blade disposal container of claim 1, wherein the open front face extends longitudinally from the upper end to the base and laterally from the first sidewall to the second sidewall.

3. The blade disposal container of claim 1, wherein the slot is disposed on a planar face of the upper end, the slot including interior walls sloping downwardly and inwardly from the planar face towards the interior volume.

4. The blade disposal container of claim 1, wherein the shield comprises a transparent planar member.

5. The blade disposal container of claim 1, wherein the perimeter edge includes an opening adjacent to the base, the opening configured to slidably receive the shield into the channel.

6. The blade disposal container of claim 1, wherein the base includes a threaded aperture configured to receive a threaded member disposed on the magnetic member for removably coupling the magnetic member to the base.

7. The blade disposal container of claim 6, wherein the threaded member comprises an adjustable screw that is removably attachable to the magnetic member.

8. The blade disposal container of claim 1, wherein the magnetic member includes a protective sleeve enclosing the magnetic member therein.

* * * * *